United States Patent [19]

Grüber

[11] 4,181,994

[45] Jan. 8, 1980

[54] APPARATUS FOR MANUFACTURING SHOES

[75] Inventor: Ernst Grüber, Winzeln, Fed. Rep. of Germany

[73] Assignee: Fortuna-Werke Maschinenfabrik GmbH, Stuttgart, Fed. Rep. of Germany

[21] Appl. No.: 855,464

[22] Filed: Nov. 28, 1977

[30] Foreign Application Priority Data

Apr. 4, 1977 [DE] Fed. Rep. of Germany ..... 2715064

[51] Int. Cl.[2] ..... A43D 119/00

[52] U.S. Cl. ..... 12/1 A; 12/17.2

[58] Field of Search ..... 12/1 A, 1 R, 77, 85, 12/88, 17.2, 33

[56] References Cited

U.S. PATENT DOCUMENTS 1,975,034 9/1934 Bata ..... 12/1 A 3,961,390 6/1976 Giordano ..... 12/1 A

FOREIGN PATENT DOCUMENTS 1902972 7/1970 Fed. Rep. of Germany ..... 12/1 A

*Primary Examiner*—Patrick D. Lawson

*Attorney, Agent, or Firm*—Martin A. Farber

[57] ABSTRACT

An apparatus for manufacturing shoes characterized by shoe lasts arranged on a conveyor with a paired alternating arrangement with the shoe toes alternately pointing in opposite directions, and by a template adapted to be moved parallel to the conveyor backwards and forwards and on the edge of which there engage mutually touching spring loaded end parts of two independently arranged control linkages, the control linkages being connected with shoe bottom part processing tools arranged at their other ends. The speed of travel of the template in the two directions is held substantially equal to the speed of advance of the conveyor.

7 Claims, 3 Drawing Figures

FIG.1
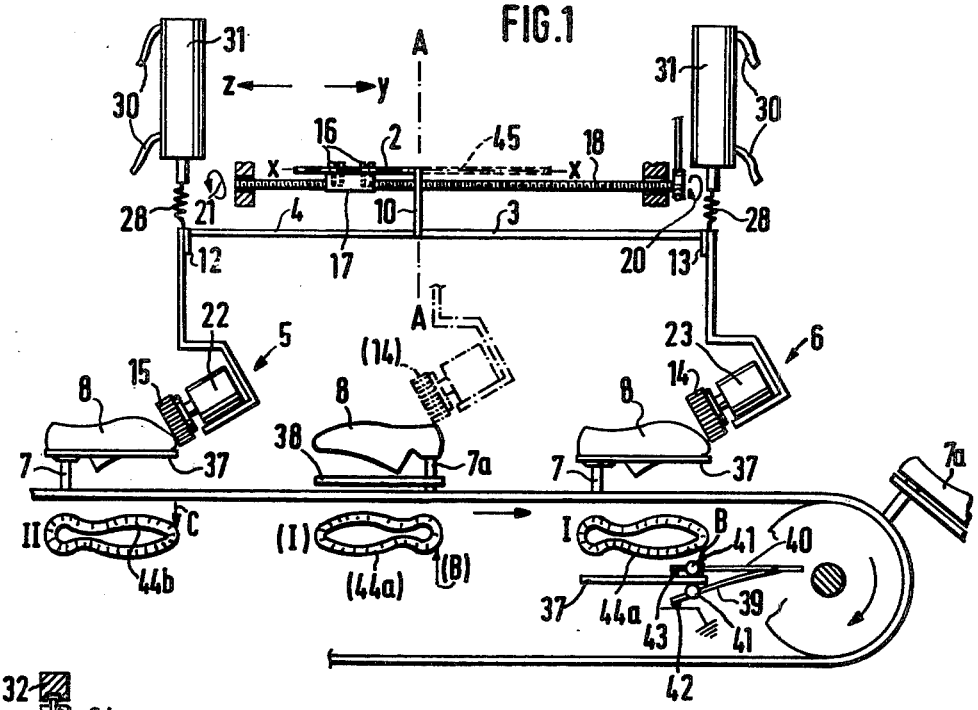
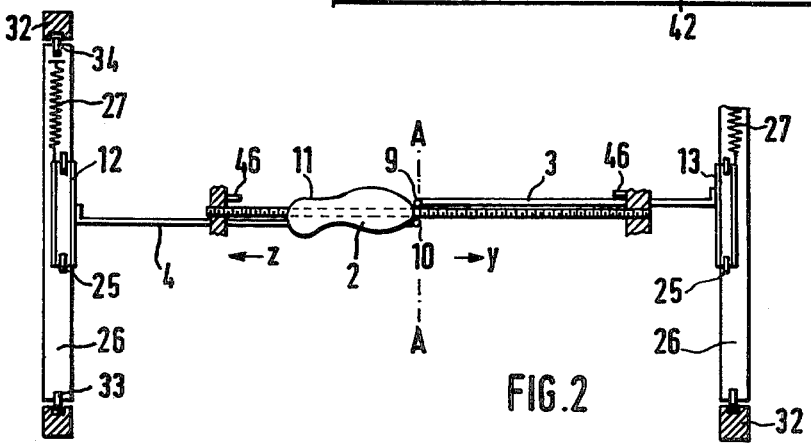
FIG.2

31
30
19
29
18
A
A
0
28
28
25
27
26
P
13
L
M
35
34
23
33
47
8
14
24
48
36
32
36
44b
44a
7
1

APPARATUS FOR MANUFACTURING SHOES

The invention relates to an apparatus for manufacturing shoes and more particularly for processing bottoms of shoes after attachment or tacking on of a shoe upper.

In accordance with a previously proposed method for manufacturing shoes the latter are arranged and held in a row with the toes alternatingly directed in opposite directions so that the shoe bottoms can be processed using a movement of an associated template, which is alternately moved in the same dircection as the shoe conveyor and then in the opposite direction, in order to provide the shoes with the desired contour.

In accordance with the invention an apparatus for carrying out this method is characterized by shoe lasts arranged on a conveyor with a paired alternating arrangement with the shoe toes alternately pointing in opposite directions, and by a template adapted to be moved parallel to the conveyor backwards and forwards and on the edge of which there engage mutually touching spring loaded end parts of two independently arranged control linkages, the control linkages being connected with shoe bottom part processing tools arranged at their other ends, the speed of advance of the conveyor being substantially equal to the speed of travel of the template in the two directions.

Further features of the invention will be gathered from the following description referring to the accompanying drawings showing a specific embodiment of the invention.

FIG. 1 shows diagrammatically the apparatus of the invention in elevation, in the case of which two shoes I and II, entering the apparatus, are shown in plan view in positions corresponding to the respective side views of the shoes, the figure also comprising a plan view of a wiper contact arrangement with an associated operating rod at the position I.

FIG. 2 shows diagrammatically the apparatus in plan view along the section line A—A in accordance with FIG. 3.

FIG. 3 shows a diagrammatic view of the apparatus as seen end-on.

Figure 3:
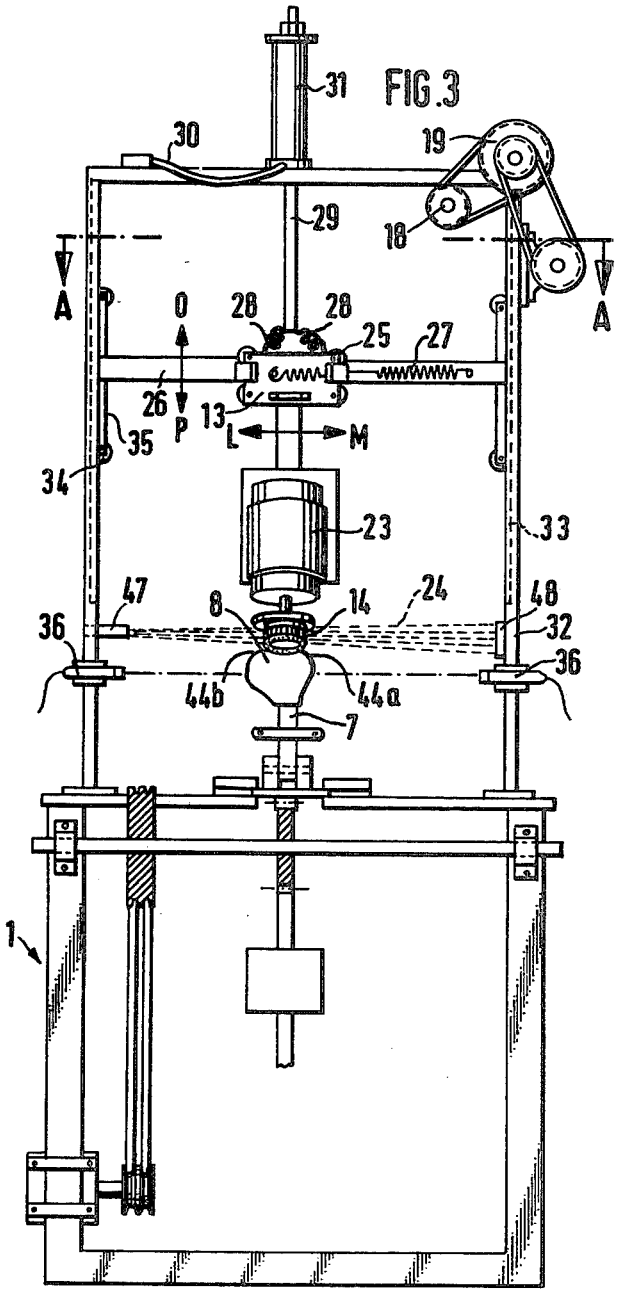

The apparatus in accordance with the invention comprises a frame 1 of metal. The chief components of the apparatus are a template 2, which moves alternately back and forth in the axial direction X—X, control linkages 3 and 4, the shoe bottom part processing tools 5 and 6 linked with the control linkages and shoe lasts 7 and *7a* directed with their toes pointing in opposite directions alternately and on which shoes 8 have been placed so that they can be easily removed. The control linkages 3 and 4 have their end parts 9 and 10—mutually opposite in a plane A—A—resiliently urged against the edge 11 of the template 2, while their other ends are connected with a support means 12 and 13 respectively for a shoe bottom processing device 14 and 15, that is to say in the present case, a shoe bottom roughening tool. The template 2 is attached by means of screws 16 on a carriage 17 so that if necessary it can be detached and replaced by another template. The carriage 17 cooperates with a threaded spindle 18, which is rotated by a belt pully 19 or the like driven by a motor (not specially shown). The motor is provided by a reversing means (not shown either) so that it can drive the belt pulley 19 and accordingly the threaded spindle 18 in one or the other direction continuously. In accordance with the specific direction of rotation of the threaded spindle, for example rotation in the direction 20, the carriage is driven in the direction of the arrow Y and when rotated in the opposite direction 21 movement takes place in the direction of the arrow Z. The shoe bottom part working tools 5 and 6, which are identical, with their respective motors 22 and 23 are attached to the support means 12 and 13 respectively. The support means 13 is provided with rollers 25 in a manner similar to a travelling hoist and it can be displaced with the rollers 25 on a support rail 26, arranged transversely with respect to the frame, in the two directions L and M and it is urged by a tension spring 27 in the direction M, that is to say towards the threaded spindle 18. The support rail 26 is attached via strong cylindrical springs 28 with the end of a piston rod 29 of a cylinder 21, which can be pneumatically reciprocated and it is provided with flexible tube connections 30 and valves which are not shown here. In a lateral frame member 32 of the frame 1 recesses 33 are provided, which receive the rollers 34 of roller holding means 35 provided at both sides at the end of the support rails 26 so that the holding rail and with it the support means 13 can be moved both vertically, that is to say in the direction O, and in the direction P. Furthermore in the frame members 32 at the same level as the shoe lasts 7, preferably adjacent to the shoe toes and heels, a photoelectric detector 36 is provided consisting for example of a light source and an opposite selenium cell. Furthermore the individual shoe lasts 7 are associated with operating rails of the same length. These rails are arranged along the longitudinal sides of the lasts and extend in the direction of the conveyor. Each last has an upper operating rail 37 and a lower operating rail 38. These operating rails are mutually offset in height in such a manner that in alternate succession one shoe last 7 is provided with a stop operating rail 37 at an upper level while the succeeding shoe last *7a* is provided with a lower operating rail 38 provided at the lower level. These operating rails 37 and 38 respectively cooperate with wiping contacts; the upper operating rail 37 cooperates with an upper wiping contact 39 and the lower operating rail 38 cooperates with a lower wiping contact 40. The operating rails and the wiping contacts cooperate in such a manner that when a last 7 or *7a* with a respective shoe arrives in the working station, via contact roller 41 a switch contact 42 is connected with ground for example and as a result a current circuit is closed, while a switching contact 43 of the other contact 39 remains unchanged in its position. The current circuit then remains closed until the contact roller 41 leaves the rail 38. Then in the same manner the switching contact 43 cooperates with the operating rail 37 and is closed so that another circuit is now closed. The photoelectric detector 36 brings about the opening and the closing of a valve, not shown here, for passing air to or from the piston 29 in a compressed air cylinder 31.

All parts arranged for cooperation with one shoe bottom part processing tool such as the linkages 3 and 4, the support means 12 and 13, the tool motors and the like—to mention only the most important parts—which in the case of this arrangement are provided in pairs, are completely identical to each other, so that it is not necessary to explain each identical part twice.

The manner of operation of the apparatus is as follows.

In the starting position the end zones of the linkages 9 and 10 lie in the plane A—A in the vicinity of a shoe toe or heel and by virtue of the spring 27 the linkages are pressed against the edge 11 of the template resiliently. These linkages are opposite to each other. In a similar manner the shoe bottom part processing tools 14 and 15, in the present case tools for roughening up the bottom part of the shoe, make engagement with a folded in, tacked or otherwise fixed part, in the present case in the vicinity of the shoe toe. In this case the shoe processing tool 14 for a shoe I makes engagement on a right hand tacked side 44*a* (note lower right-hand portion of FIG. 1) in the direction of the arrow B in the direction of travel of the conveyor, while for a shoe II makes engagement in the direction of the arrow C, that is to say on the left hand side 44*b* (note lower left-hand portion of FIG. 1) in terms of the direction of movement of the conveyor. The roughening tools are stopped as soon as the light beam of the photoelectric detector 36 is interrupted by the arriving workpiece, that is to say the shoe on its last. Via a solenoid valve regulating the engagement pressure the cylinder 31 is vented and the piston 29 with the support rail 26 and the support 13 and also the tool 14 or 15 are lowered in the direction of the arrow P on to the work. The different types of leather and the respectively necessary depth of roughening make it necessary to be able to regulate the engagement pressure in the above mentioned manner. Simultaneously the switch contact 41 closes the first reversing circuit for the drive motor of the threaded spindle, which accordingly now rotates, driven by the belt drive and the like 19 and moves the carriage 17 in the direction of the arrow Y. When this is done the ends 9 and 10 (which are) pressed against the edge 11 of the template with a spring force) of the control linkages correctly sense the contour and transmit every transverse movement brought about via these control linkages to the supports 12 and 13, which on their respective support rail 26 can be moved in the directions of the arrows L and M. In accordance with the template contour which essentially corresponds to the shoe sole to be processed, the shoe bottom processing tools 5 and 6 carry out an oscillating movement and these movements are transmitted in strict accordance with the contour to the shoe sole, in the present case the respective inlaid tacked part 44*a* and respectively 44*b*, which due to the synchronous speed of the template with respect to the shoe sole always processes the correct portion at the correct time, that is to say it carries out the desired roughening operation. After the shoe last has passed through this station with the shoe the photoelectric detector ceases to be affected, the tool is moved clear of the work by actuation of the cylinder 31 moving the piston 29, whose springs 28 ensure a gentle contacting of the tool on the bottom part of the shoe. Simultaneously the wiping contact 40 comes clear of the operating rail 38 and the switching contact 41 interrupts the current circuit. Simultaneously the motor for the threaded spindle is stopped by the conveyor, the conveyor moving on continuously. The conveyor then brings the heel end into the processing station and the previously described operation is started once again with the only departure that the upper operating rail 37 actuates the wiping contact 39, which now closes the switching contact 43 and as a result the motor of the threaded spindle is reversed and the spindle, turned in the opposite direction 21, moves the carriage with the template, which is represented in its initial position in broken lines at 45, in the direction of the arrow Z, this time with the heel first.

By means of a starting switch 46, constructed as a pressure switch and by means of which a turn off switch can be operated, measures are taken to insure that, if a fault should occur in the electric circuit, the carriage with the template can move past a certain limit.

Dust produced by roughening material is removed by a compressed air device 47, which blows the dust into a draw-off device 48, from the processing stations to the greatest possible extent.

The appropriate positioning of the workpieces on the one hand and the possibilities of mechanical movement of the chief parts in relation to each other and the work to be processed, linked with the appropriate circuit arrangement have for the first time provided simultaneous processing without any substantial movements of the tools towards and away from the work.

Due to the construction on a modular basis using square tubes, which are joined together to form a frame, the latter can be extended as required by adding connecting pieces, so that if the endless circulating conveyor is suitably lengthened the arrangement, only described here for roughening the bottom parts of the shoes, can be extended to provide further working stations using the same principle, such stations providing for example for the application of adhesive, drying, for filling the shoe bottom parts, and the application of pre-fabricated cemented, activated soles to the shoe bottom parts, just to mention the most important operations.

What we claim is:

1. In an apparatus for manufacturing shoes comprising an endless circulating conveyor adapted to hold shoes upside down in a detachable manner and tools arranged in a row for processing the shoe bottom parts, with individual shoe lasts arranged on the conveyor in a paired alternating arrangement with the shoe toes alternately pointing in opposite directions the improvement comprising, a template having an edge corresponding to the contour of shoe bottom parts to be worked and adapted to be moved parallel o the conveyor backwards and forwards, two independently arranged control linkages having spring-biased end parts, respectively, engaging said edge of said template on mutually opposite long sides thereof, shoe bottom part processing tools connected to other ends of said control linkages, respectively, means for maintaining the speed of advance of the conveyor substantially equal to the speed of travel of said template in the two directions.

2. An apparatus in accordance with claim 1, wherein said control linkages have said end parts resting against said edge of said template in a single plane opposite each other and with a spring biasing action, and supports operatively support said other ends of said control linkages and said tools.

3. An apparatus in accordance with claim 1 further comprising a threaded spindle, a carriage is operatively mounted on said threaded spindle, said template is detachably connected with said carriage, a motor is connected to said threaded spindle.

4. An apparatus in accordance with claim 2, further comprising means for moveably mounting said supports and said tools for movement thereof in planes both horizontally and vertically.

5. An apparatus in accordance with claim 3, characterized in that said individual shoe lasts each include a respective operating rail (37 and 38 respectively) arranged on longitudinal sides thereof and switching contact means (39 and 40, respectively) slidably cooperates with each said operating rail for respectively turning on and off and reversing said motor.

6. An apparatus in accordance with claim 1, further comprising cylinder means having a solenoid regulating valve for vertically adjusting an engagement pressure of said tools on said shoe bottom parts.

7. The apparatus as set forth in claim 1, wherein adjacent of said individual shoe lasts have said respective operating rail located offset in height relative to each other, said adjacent of said shoe lasts are mounted so as to receive shoes thereon in upside down reversed position relative to each other, said switching contact means for turning-on said motor during engagement on said operating rail.

* * * * *